US011250674B2

(12) United States Patent
Hosokawa et al.

(10) Patent No.: US 11,250,674 B2
(45) Date of Patent: Feb. 15, 2022

(54) INPUT/OUTPUT DEVICE AND TERMINAL DEVICE

(71) Applicant: NEC Corporation, Tokyo (JP)

(72) Inventors: Tatsuro Hosokawa, Tokyo (JP); Naoki Morishita, Tokyo (JP); Yutaro Kitahata, Tokyo (JP); Jun Kondo, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/981,034

(22) PCT Filed: Oct. 19, 2018

(86) PCT No.: PCT/JP2018/039006
§ 371 (c)(1),
(2) Date: Sep. 15, 2020

(87) PCT Pub. No.: WO2019/181037
PCT Pub. Date: Sep. 26, 2019

(65) Prior Publication Data

US 2021/0065521 A1 Mar. 4, 2021

(30) Foreign Application Priority Data

Mar. 20, 2018 (JP) ..... JP2018-052698

(51) Int. Cl.
*G07F 19/00* (2006.01)
*G07D 11/14* (2019.01)

(52) U.S. Cl.
CPC ..... *G07F 19/205* (2013.01); *G07D 11/14* (2019.01); *G07F 19/201* (2013.01)

(58) Field of Classification Search
CPC ..... G07F 19/205; G07D 11/60
See application file for complete search history.

(56) References Cited

U.S. PATENT DOCUMENTS 6,116,597 A * 9/2000 Rowe ..... G07F 17/3216 273/143 R
6,702,667 B2 * 3/2004 Mattice ..... G07F 17/32 273/148 R (Continued)

FOREIGN PATENT DOCUMENTS

JP 2000-057416 A 2/2000
JP 2004-164240 A 6/2004

(Continued)

OTHER PUBLICATIONS

International Search Report for PCT Application No. PCT/JP2018/039006, dated Jan. 22, 2019.
Japanese Office Action for JP Application No. 2018-052698 dated Feb. 26, 2019 with English Translation.

(Continued)

*Primary Examiner* — Christle I Marshall

(57) ABSTRACT

An input and output device includes: an operation unit that is disposed on a front side and that receives data input by an operator; and a table unit that is disposed further forward than the operation unit and that protrudes in a forward direction. The table unit includes: a notched portion that is provided on a first side in a left-right direction and that opens forward and upward; and a recessed portion that is provided on a second side in the left-right direction, the first side being opposite to the first side, the recessed portion comprising an upper surface having a recessed shape.

14 Claims, 5 Drawing Sheets

(56) References Cited

U.S. PATENT DOCUMENTS

| | | | | |
|---|---|---|---|---|
| 6,779,794 | B2 * | 8/2004 | Hedrick | G07F 17/32 273/148 R |
| 9,305,423 | B2 * | 4/2016 | Salzman | G07F 17/3216 |
| 2010/0062862 | A1 * | 3/2010 | Shimizu | G07F 17/3206 463/46 |

FOREIGN PATENT DOCUMENTS

| | | | | |
|---|---|---|---|---|
| JP | 2005-165782 | A | | 6/2005 |
| JP | 2006-277710 | A | | 10/2006 |
| JP | 2007-079733 | A | | 3/2007 |
| JP | 2008-213758 | A | | 9/2008 |
| JP | 2010012121 | A | * | 1/2010 |
| JP | 2010-134634 | A | | 6/2010 |
| JP | 2012-009080 | A | | 1/2012 |
| JP | 2012-027730 | A | | 2/2012 |
| JP | 2013-112173 | A | | 6/2013 |
| JP | 2013-246797 | A | | 12/2013 |
| JP | 2014-056495 | A | | 3/2014 |
| JP | 2014-137703 | A | | 7/2014 |
| JP | 2015-225472 | A | | 12/2015 |
| JP | 2016-157261 | A | | 9/2016 |
| JP | 2017-117347 | A | | 6/2017 |

OTHER PUBLICATIONS

Japanese Notice of Allowance for JP Application No. 2018-052698 dated Oct. 1, 2019 with English Translation.

Seven Bank LTD., 4th generation ATM store bring-in verification results (flash report), Nov. 28, 2017, Japan, with partial translation.

* cited by examiner

INPUT/OUTPUT DEVICE AND TERMINAL DEVICE

This application is a National Stage Entry of PCT/JP2018/039006 filed on Oct. 19, 2018, which claims priority from Japanese Patent Application 2018-052698 filed on Mar. 20, 2018, the contents of all of which are incorporated herein by reference, in their entirety.

TECHNICAL FIELD

The present invention relates to a terminal device such as, for example, an automatic teller machine (ATM), and an input and output device applied to the operation thereof.

BACKGROUND ART

Patent Document 1 discloses a store visit reception system that uses an input and output device of an automatic teller machine operated by a user.

This store visit reception system includes a reception terminal, a baggage table, and a baggage-detecting sensor. The reception terminal is installed in the lobby or the like in a store of a financial institution. The baggage table is provided on the front surface of the reception terminal. Baggage, such as a bag or wallet, glasses, an umbrella, or a coat, may be placed on the baggage table. The baggage-detecting sensor detects the presence or absence of baggage placed on the baggage table by measuring weight.

This store visit reception system further includes an operation display unit. The operation display unit is provided on the front surface of the reception terminal, and is formed from a combination of a display screen, such as an LCD (Liquid Crystal Display), and a touch panel. The operation display unit displays, on the display screen, a screen inquiring the purpose of the user's visit or a screen prompting the user to perform an operation. Additionally, the operation display unit receives inputs from the user via the touch panel.

PRIOR ART DOCUMENTS

Patent Documents

[Patent Document 1]
Japanese Unexamined Patent Application, First Publication No. 2005-165782

SUMMARY OF THE INVENTION

Problem to be Solved by the Invention

In the store visit reception system described in Patent Document 1, in consideration of the convenience to the user operating the terminal, the baggage table for placing a bag carried by the user is provided on the front surface of the terminal. The user sometimes carries something other than a bag, for example, an incidental item such as a drink or a cane. In such a case, the user placing the incidental item at an improper location on the baggage table may cause a problem to occur in the machine or the like.

For example, with the store visit reception system in Patent Document 1, there is a risk that a problem will occur, such as a drink falling over onto the baggage table and flowing into the machine, thus causing a malfunction. Additionally, if the user places a cane against the side of the machine, there is a risk that the cane will be forgotten.

The present invention has been made in consideration of the above-mentioned circumstances. An example object of the present invention is to provide an input and output device and a terminal device that prevent the occurrence of problems caused by items carried by the user.

Means for Solving the Problem

An input and output device according to an example aspect of the present invention includes: an operation unit that is disposed on a front side and that receives data input by an operator; and a table unit that is disposed further forward than the operation unit and that protrudes in a forward direction. The table unit includes: a notched portion that is provided on a first side in a left-right direction and that opens forward and upward; and a recessed portion that is provided on a second side in the left-right direction, the first side being opposite to the first side, the recessed portion comprising an upper surface having a recessed shape.

Effect of the Invention

According to an example embodiment of the present invention, it is possible to prevent the tipping and forgetting of a drink, and to prevent the dropping or forgetting of a cane, by placing a beverage container, a cane, or the like at a predetermined location.

EXAMPLE EMBODIMENTS FOR CARRYING OUT THE INVENTION

Figure 1:
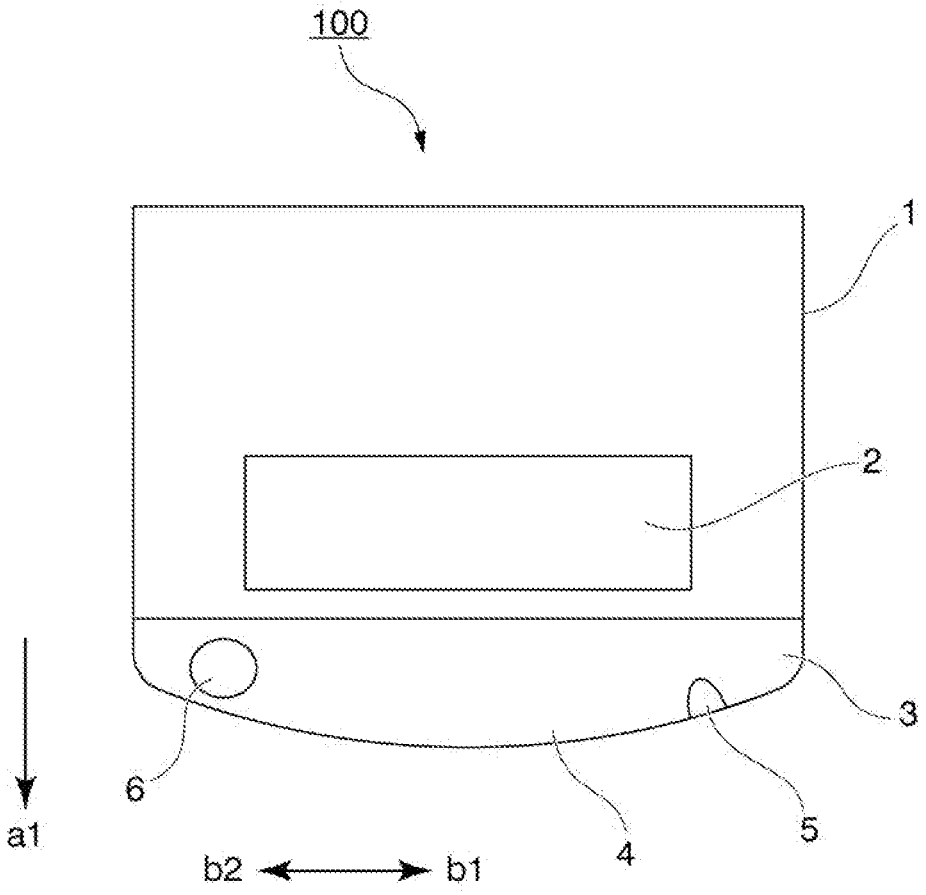
FIG. 1 is a diagram illustrating the schematic structure of an input and output device according to an example embodiment of the present invention.

As one example of the structure of an example embodiment of the present invention, an input and output device 100 will be explained with reference to FIG. 1.

This input and output device 100 includes a device main body 1, an operation unit 2 that is provided on the device main body 1 and that is operated by an operator, and a table unit 3 that is provided on the front portion of the operation unit 2.

The operation unit 2 is provided on the front-surface side (the direction of the arrow al) of the device main body 1, where the operator is located. The operation unit 2 is formed from a touch-type operation screen, a numeric keypad, an IC card reading unit, or the like, for inputting and outputting data with respect to the machine.

The table unit 3 has a stepped portion 4 that protrudes forward from the operation unit 2. Baggage such as a bag or outerwear may be placed on the upper surface of the stepped portion 4.

A notched portion 5 and a recessed portion 6 are provided in the stepped portion 4 in the table unit 3.

The notched portion 5 is located on one side (the side of the arrow b1) in the left-right direction (the direction of the arrows b1-b2) of the stepped portion 4, and is formed so as to open forward and upward. The notched portion 5 is provided at the edge of the stepped portion 4.

The recessed portion 6 is located on the other side (the side of the arrow b2) in the left-right direction of the stepped portion 4, and has, on the upper surface thereof, a recessed shape corresponding to a beverage container. The recessed portion 6 is able to accommodate a beverage container.

With the input and output device 100 configured as described above, a notched portion 5 that opens forward and upward is provided on one side (the side of the arrow b1) in the left-right direction of the stepped portion 4 of the table unit 3, which protrudes forward. Additionally, a recessed portion 6 having an upper surface with a shape that is recessed so as to correspond to a beverage container is provided on the other side (the side of the arrow b2) in the left-right direction of the stepped portion 4.

Furthermore, a rod-shaped body such as a cane or an umbrella can be hooked in the notched portion 5 in this table unit 3. Additionally, a drink container can be placed in the recessed portion 6 in the table unit 3.

Thus, with the input and output device 100, a beverage container, a cane, or the like can be placed in the notched portion 5 and the recessed portion 6, which are at predetermined locations. For this reason, the tipping or forgetting of drinks and the dropping or forgetting of canes can be surely prevented simply by a user paying attention to certain limited locations.

EXAMPLE EMBODIMENTS

As one example of an input and output device 101 according to an example embodiment of the present invention, an automatic teller machine A will be explained with reference to FIGS. 2 to 5.

Figure 2:
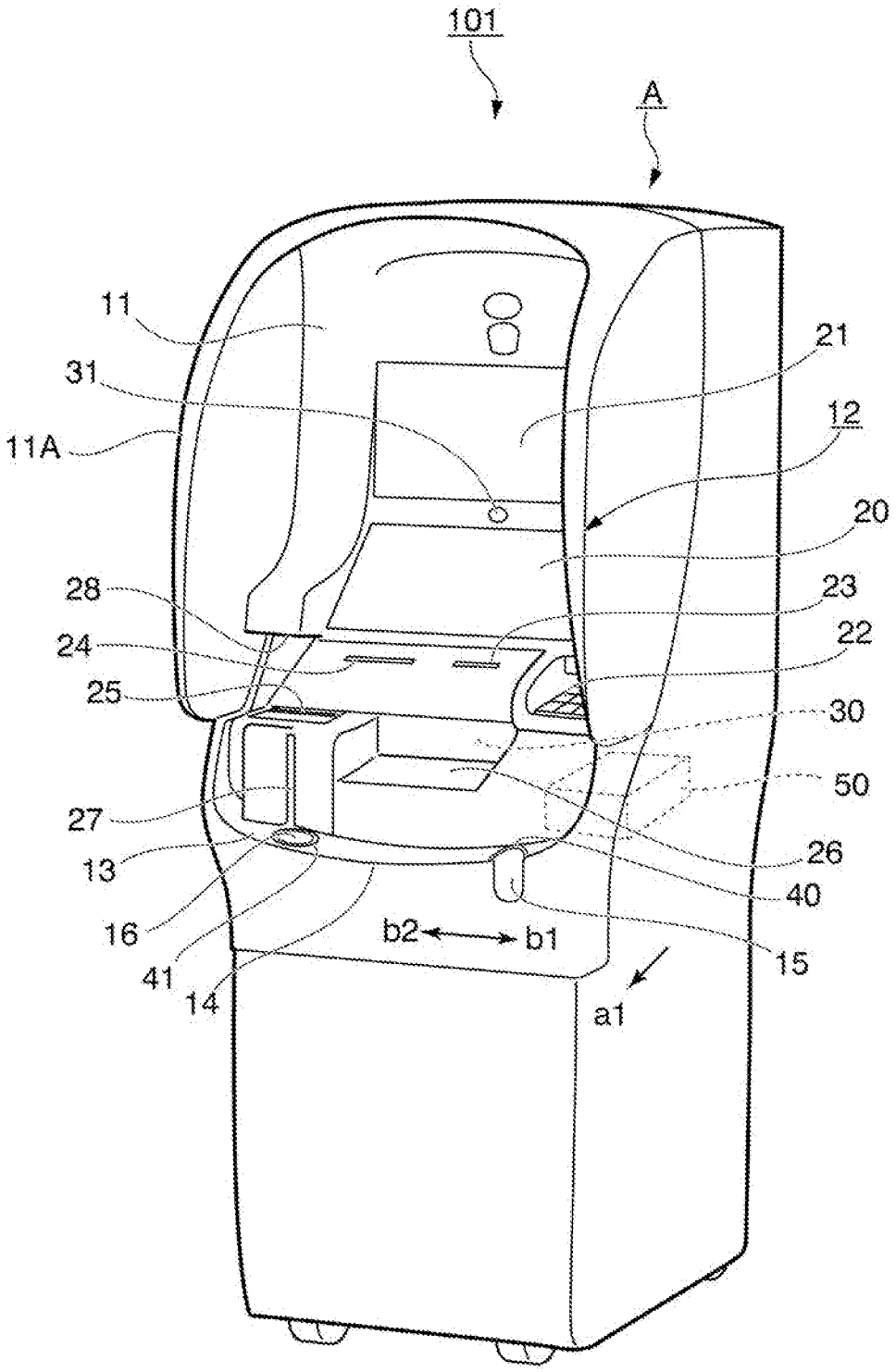
FIG. 2 is a perspective view of an input and output device according to another example embodiment of the present invention.
Figure 3:
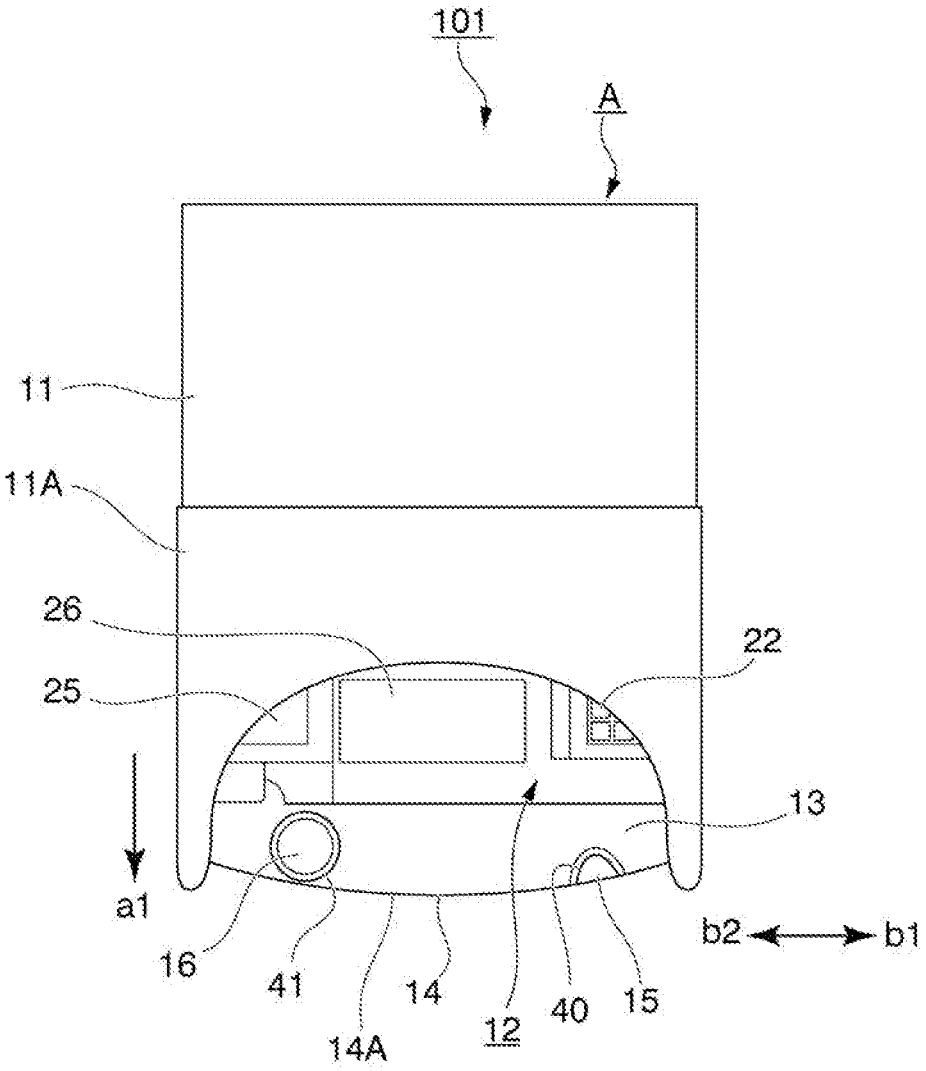
FIG. 3 is a plan view of the input and output device illustrated in FIG. 2.
Figure 4:
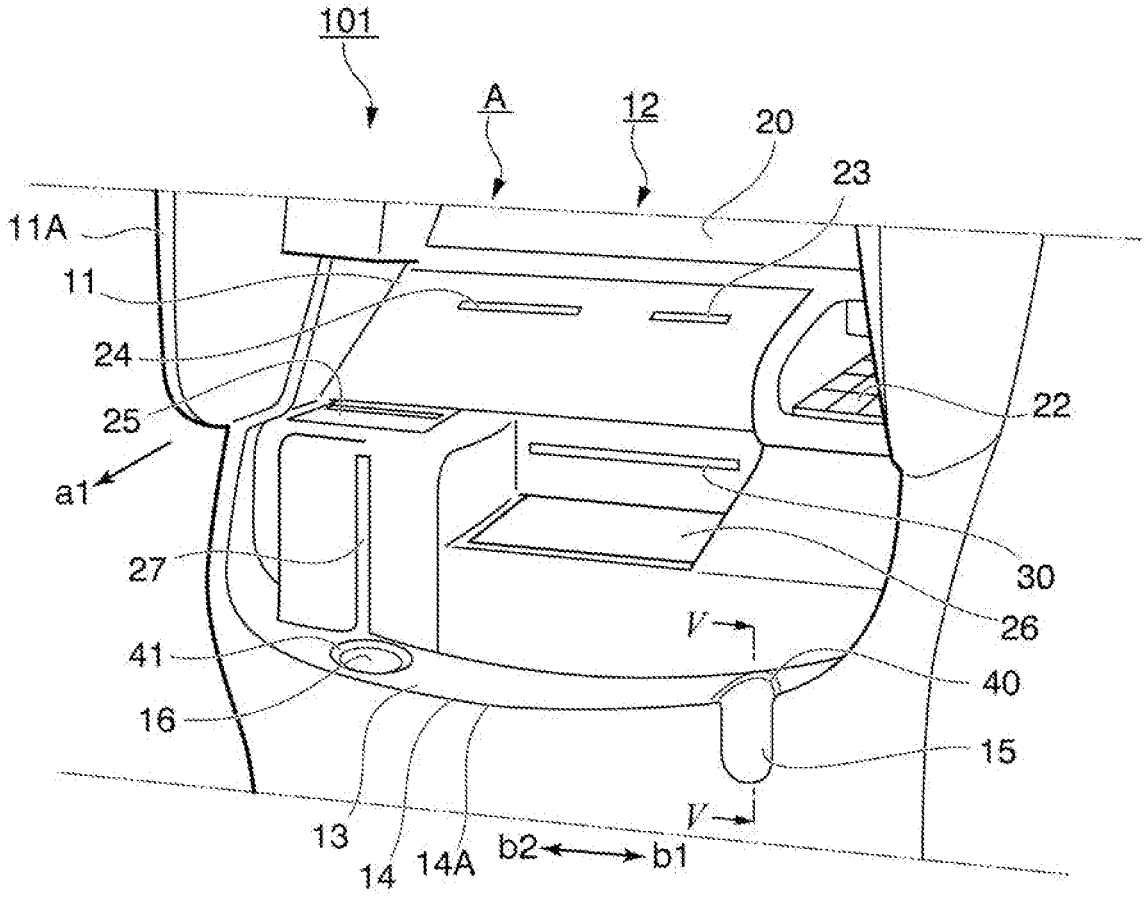
FIG. 4 is a perspective view of the input and output device illustrated in FIG. 2 with an essential portion enlarged.

As illustrated in FIGS. 2 to 4, this automatic teller machine A includes a device main body 11, an operation unit 12, and a table unit 13. The device main body 11 performs cash depositing and withdrawal processes. The operation unit 12 is provided on the front-surface side (the direction of the arrow al) of the device main body 11, and receives operations relating to the depositing and payment of cash. The table unit 13 is provided on the front portion of the operation unit 12, and has a horizontal or substantially horizontal upper surface.

The operation unit 12 is arranged to be on the front-surface side (the direction of the arrow al) of the device main body 11, where the operator is located. The operation unit 12 is formed from a touch-type operation screen, a numeric pad, an IC card reading unit, or the like, for inputting and outputting data with respect to the machine.

Specifically, the operation unit 12 includes a first panel 20 and a second panel 21 that are provided at an upper position of the device main body 11, and, a numeric pad 22, a card insertion port 23, a receipt port 24, an IC card reading unit 25, a paper money transfer port 26, an intercom 27, a skimmer-detecting camera 28, a human sensor 30, and a security camera 31 that are provided at an intermediate position of the device main body 11.

The first panel 20 is a touch-type operation panel that is operated by a user.

The second panel 21 is located above the first panel 20. The second panel 21 is a display indicating that the automatic teller machine A is an automatic teller machine, and also indicating usable card information, campaign information, commercial messages, and the like. The first panel 20 and the second panel 21 are one example of active units.

The numeric pad 22 is provided on one side (the right side in the figure) in the left-right direction (the direction of the arrows b1-b2) of the device main body 11. The numeric pad 22 receives, from the operator, an input such as a password or a monetary amount to be withdrawn.

The card insertion port 23 is an opening unit for inserting a card used when depositing and withdrawing paper money.

The paper money transfer port 26 is a paper money port for feeding and dispensing paper money. When a shutter (illustrated) on the paper money transfer port 26 is open, paper money is placed in or removed from the automatic teller machine A by a user through the paper money transfer port 26.

The intercom 27 is provided on the other side (the left side in the figure) in the left-right direction (the direction of the arrows b1-b2) of the device main body 11. The intercom 27 is used when an operator communicates with a person at a call center.

The skimmer-detecting camera 28 is an imaging device (first imaging device) that is provided in order to watch for improper actions at the card insertion port 23 and the paper money transfer port 26, or in the vicinity thereof.

This skimmer-detecting camera 28 can watch for improper actions in the vicinity of the card insertion port 23 and the like, and can also read information in recording media placed at a reading position of the IC card reading unit 25.

The human sensor 30 is a detector for detecting whether or not there is a user in front of the operation unit 12. The human sensor 30 outputs a signal (human detection signal) indicating whether or not there is a user in front of the operation unit 12.

The security camera 31 is installed between the first panel 20 and the second panel 21. The watch area of the security camera 31 is set to be in front of the operation unit 12. When the human sensor 30 detects a person, the security camera 31 captures an image of the user standing in front of the operation unit 12. The security camera 31 is one example of a second imaging device.

Inside the device main body 11, a data processing device 50 is provided for processing information input from the first panel 20, the numeric pad 22, the card insertion port 23 and the IC card reading unit 25. The data processing device 50 may be one example of a control unit. The data processing device 50 may process information acquired by the human sensor 30 and the skimmer-detecting camera 28. The data processing device 50 may include a CPU and a memory unit. Inside the device main body 11, a money deposit/withdrawal device (not illustrated) for charging and dispensing/feeding paper money with respect to the paper money transfer port 26 based on a signal from the data processing device 50, and a printing device (not illustrated) for printing a receipt to be dispensed from the receipt port 24 are further provided.

On the front surface of the device main body 11, a cover 11A is installed. This cover 11A has side plates covering the operation unit from the sides, and an upper plate covering the operation unit from above. These side plates and the upper plate enclose the operation unit from the surroundings, thereby preventing screen operations and the like from being seen from the outside.

Next, the table unit 13 provided on the front portion of the operation unit 12 will be explained with reference to FIG. 4.

The table unit 13 has a stepped portion 14 that protrudes forward (the direction of the arrow al) from the operation unit 12. Baggage such as a bag or outerwear may be placed on the upper surface of the stepped portion 14 (table unit 13).

This stepped portion 14 (table unit 13) has a round shape in which a front edge 14A protrudes so as to trace an arc in the forward direction. The operator may push against or lean on the the front edge 14A of the stepped portion 14 (table unit 13). The operator can perform the operations for depositing/withdrawing money and the like with a stable posture supported by the stepped portion 14 in this way.

A notched portion 15 and a recessed portion 16 are provided on both sides in the left-right direction (the direction of the arrows b1-b2) of the stepped portion 14 of the table unit 13.

The notched portion 15 is located on the right side (the side of the arrow b1) in the left-right direction of the stepped portion 14. The notched portion 15 opens forward and upward. The notched portion 15 is arranged to be on the side of the numeric pad 22 provided as a portion of the operation unit 12.

Figure 5:
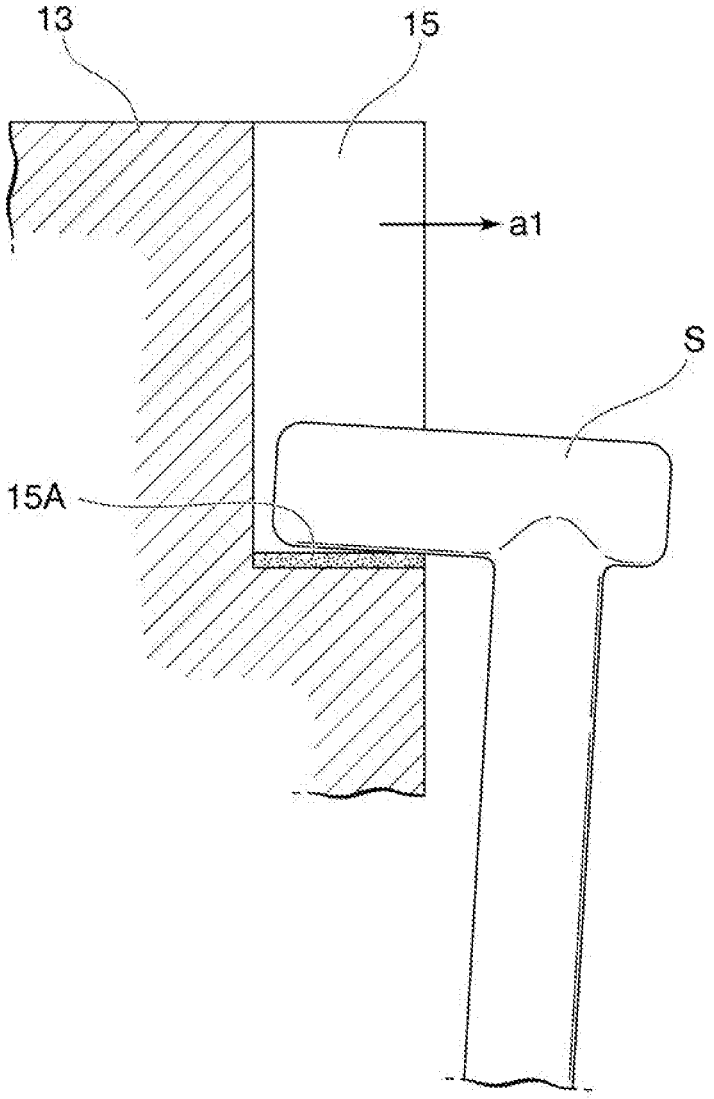
FIG. 5 is a section view along the line V-V at the notched portion illustrated in FIG. 4.

As illustrated in FIG. 5, this notched portion 15 functions as a stick holder for hooking a rod-shaped body (indicated by the reference symbol S) such as a cane or an umbrella. A lower surface 15A in the notched portion 15 may be formed from a material having a high frictional coefficient. The lower surface 15A inside the notched portion 15 may be formed so as to tilt downward towards the rear. By providing this notched portion 15 with such a structure, it becomes possible to hook the rod-shaped body onto the notched portion 15 in a more stable state.

The recessed portion 16 is located on the left side (the side of the arrow b2) in the left-right direction (the direction of the arrows b1-b2) of the stepped portion 14. The upper surface of the recessed portion 16 has a recessed shape corresponding to a beverage container. The recessed portion 16 is arranged to be on the side of the intercom 27 provided as a portion of the operation unit 12.

The aforementioned round shape of the stepped portion 14 includes a slightly larger width and protrudes further forward (in the direction of the arrow al) than the recessed portion 16. In other words, the width, in the front-rear direction, of the central portion of the stepped portion 14 is greater than that of the stepped portion 14 at the position where the recessed portion 16 is provided.

Light emitting units 40, 41 are provided respectively on the notched portion 15 and the recessed portion 16. These light emitting units 40, 41 are set so as to emit visible light when the presence of an operator is detected by the human sensor 30. The light emitting units 40, 41, by emitting visible light, notify the operator of the positions at which articles are to be placed (in other words, the positions of the notched portion 15 and the recessed portion 16).

The visible light from the light emitting units 40, 41 is detected by the skimmer-detecting camera 28 (see FIG. 2). The skimmer-detecting camera 28 is one example of a light detecting unit. Here, at least some of the light emitted from the light emitting unit 40 and directed towards the skimmer-detecting camera 28 is blocked by an article, such as a cane, placed at the notched portion 15. Thus, the amount of light that is emitted from the light emitting unit 40 and that is directed towards the skimmer-detecting camera 28 changes depending on whether or not an article is placed in the notched portion 15. Therefore, the skimmer-detecting camera 28 detects different amounts of light depending on whether or not an article is placed in the notched portion 15. Similarly, the skimmer-detecting camera 28 detects different amounts of light depending on whether or not an article is placed in the recessed portion 16. The skimmer-detecting camera 28 outputs a detection signal (article detection signal) in accordance with the amount of light that is detected.

When the human sensor 30 detects that an operator has left the operation unit 12, the data processing device (control unit) 50 determines whether or not the visible light is being blocked by an object (a beverage, a cane, or the like) based on the detection signal from the skimmer-detecting camera 28. If it is determined that the visible light (at least some of the visible light) is blocked, then the data processing device 50 alerts the operator that the operator has forgotten the object by means of audio, a warning lamp, or the like.

Based on the warning by audio or the like, the operator can be notified of things that the operator has forgotten in the notched portion 15 and the recessed portion 16.

With the input and output device 101 of the present example embodiment configured as described above, a notched portion 15 that opens forward and upward is provided on the right side in the left-right direction (the direction of the arrows b1-b2) of the stepped portion 14 of the table unit 13, which protrudes in the forward direction. Additionally, a recessed portion 16 having a recessed shape corresponding to a beverage container on the upper surface is provided on the left side in the left-right direction of the stepped portion 14.

A rod-shaped body such as a cane or an umbrella can be hooked in the notched portion 15 in this table unit 13. Additionally, a drink container can be placed in the recessed portion 16 in the table unit 13.

Thus, in the input and output device 101 in the present example embodiment, a beverage container, a cane, or the like can be placed at predetermined locations. For this reason, the forgetting and tipping of drinks and the forgetting of canes can be surely prevented. As a result thereof, the reliability of the machine overall can be raised.

In the above-described example embodiment, an example in which an automatic teller machine A is used as the input and output device 101 is indicated. However, the example embodiments of the present invention are not limited thereto. An example embodiment of the present invention may be applied to a multimedia information terminal installed in a convenience store, to an automatic ticket machine at a station, or the like. In other words, example embodiments of the present invention can be applied to various types of terminal devices having active units for performing operations to take in or discharge objects such as paper money, tickets, printed matter, or the like, or for displaying information on a display or the like, based on information input or output with respect to the input and output device 101.

In the above-described example embodiment, the shape of the stepped portion 14 of the table unit 13 is round. However, the example embodiments of the present invention are not limited thereto. The round shape may be a shape forming part of a perfect circle, a shape forming part of an ellipse, or an angular shape.

In the above-described example embodiment, light emitting units 40, 41 for notifying an operator of locations at which objects are to be placed by means of visible light are provided in both the notched portion 15 and the recessed portion 16. However, in an example embodiment of the present invention, it may be provided in just one of the notched portion 15 and the recessed portion 16. For example, a light emitting unit may be provided in whichever of the notched portion 15 and the recessed portion 16 is used more frequently.

In the above-described example embodiment, the skimmer-detecting camera 28 is used as the light detecting unit for detecting visible light from the light emitting units 40, 41. However, the example embodiments of the present invention are not limited thereto. The security camera 31 may be used as the light detecting unit. As a different method, the visible light from the light emitting units 40, 41 may be detected by a camera dedicated thereto. At least one of the skimmer-detecting camera 28 and the security camera 31 may be an optical sensor for detecting visible light reflected by at least one of a user's background and a sheet-shaped article on which information is printed.

According to the above-described example embodiment, an optical sensor such as a camera that is considered to be necessary for the functions of the automatic teller machine is used to detect whether, after a transaction ends (after the passage of the time necessary for a user to leave), there is no change in the light reception amount of light rays (increases or decreases in the light reception amount due to being covered or uncovered by a cane or a drink) from the light emitting units 40, 41. Due to this structure, an alarm regarding forgotten articles such as a cane or a drink can be issued without performing complicated image processing.

As a further simplified structure, even if a person is not detected by the person sensor 30, an alarm may be issued on just the condition that the light emitting units 40, 41 remain covered and the light reception amount does not increase.

Example embodiments of the present invention have been explained in detail above with reference to the drawings. However, the specific structure is not limited to these example embodiments, and design modifications and the like are included within a range not departing from the spirit of the present invention.

Some or all of the above-described example embodiments may be described as in the appendices below, but the invention is not limited thereto.

(Supplementary Note 1)

An input and output device comprising:

an operation unit that is disposed on a front side and that receives data input by an operator; and a table unit that is disposed further forward than the operation unit and that protrudes in a forward direction, wherein the table unit comprises:

a notched portion that is provided on a first side in a left-right direction and that opens forward and upward; and a recessed portion that is provided on a second side in the left-right direction, the first side being opposite to the first side, the recessed portion comprising an upper surface having a recessed shape.

(Supplementary Note 2)

The input and output device according to supplementary note 1, wherein the recessed portion has a shape corresponding to a beverage container.

(Supplementary Note 3)

The input and output device according to supplementary note 1 or 2, wherein the table unit has a round shape that protrudes forward.

(Supplementary Note 4)

The input and output device according to any one of supplementary notes 1 to 3, wherein the notched portion comprises a stick holder for hooking a rod-shaped body.

(Supplementary Note 5)

The input and output device according to any one of supplementary notes 1 to 4, wherein the operation unit comprises a numeric pad, and the notched portion is disposed on a side of the numeric pad.

(Supplementary Note 6)

The input and output device according to any one of supplementary notes 1 to 5, wherein the operation unit comprises an intercom, and the recessed portion is disposed on a side of the intercom.

(Supplementary Note 7)

The input and output device according to any one of supplementary notes 1 to 4, wherein the operation unit comprises a numeric pad and an intercom, a distance between the notched portion and the numeric pad is shorter than a distance between the notched portion and the intercom, and a distance between the recessed portion and the intercom numeric pad is shorter than a distance between the recessed portion and the numeric pad.

(Supplementary Note 8)

The input and output device according to any one of supplementary notes 1 to 7, wherein at least one of the notched portion and the recessed portion is provided with a light emitting unit that notifies an operator, by visible light, of a location at which an article is to be placed.

(Supplementary Note 9)

The input and output device according to supplementary note 8, further comprising:

a light detecting unit that detects the visible light from the light emitting unit and outputs a detection signal; and a control unit that determines, based on the detection signal, whether or not the visible light is blocked by an object placed in the notched portion or the recessed portion when the operator leaves the operation unit, the control unit alerting the operator that the object has been forgotten upon determining that the visible light is blocked.

(Supplementary Note 10)

The input and output device according to supplementary note 9, wherein the light detecting unit comprises an optical sensor that is provided on the front side, the light detecting unit detecting visible light reflected by at least one of the operator, a background of the operator, and a sheet-shaped article on which information is printed.

(Supplementary Note 11)

The input and output device according to supplementary note 9 or 10, wherein the light detecting unit comprises a camera that acquires image information.

(Supplementary Note 12)

The input and output device according to any one of supplementary notes 1 to 7, wherein the table unit comprises:

a first light emitting unit that is disposed on an edge of the recessed portion and that emits light to indicate a location of the recessed portion; and a second light emitting unit that is disposed on an edge of the notched portion and that emits light to indicate a location of the notched portion.

(Supplementary Note 13)

The input and output device according to supplementary note 13, further comprising:

a human sensor that detects the operator and that outputs a human detection signal indicating whether or not the operator is present;

a light detecting unit that detects visible light emitted from at least one of the first and the second light emitting units, and that outputs an article detection signal indicating whether or not an article is placed in at least one of the recessed portion and the notched portion; and a control unit that determines that the operator has forgotten an object when the human detection signal indicates that the operator is absent and the article detection signal indicates that the article is placed in the at least one of the recessed portion and the notched portion.

(Supplementary Note 14)

The input and output device according to any one of supplementary notes 1 to 13, wherein the left-right direction is substantially perpendicular to a direction away from the operation unit.

(Supplementary Note 15)

A terminal device comprising:

the input and output device according to any one of supplementary notes 1 to 14; and an active unit that performs at least one of operating an object and displaying information based on data input from the input and output device.

This application is based upon and claims the benefit of priority from Japanese Patent Application No. 2018-052698, filed Mar. 20, 2018, the disclosure of which is incorporated herein in its entirety.

INDUSTRIAL APPLICABILITY

The present invention pertains to an input and output device that is applied to an operation unit of a terminal device such as an automatic teller machine.

REFERENCE SYMBOLS

1 Device main body
2 Operation unit
3 Table unit
4 Stepped portion
5 Notched portion
6 Recessed portion
11 Device main body
12 Operation unit
13 Table unit
14 Stepped portion
15 Notched portion
16 Recessed portion
28 Skimmer-detecting camera
40 Light emitting unit
41 Light emitting unit
100 Input and output device
101 Input and output device
A Automatic teller machine

The invention claimed is:

1. An input and output device comprising:

an operation unit that is disposed on a front side and that receives data input by an operator;

a table unit that is disposed further forward than the operation unit and that protrudes in a forward direction;

a human sensor that detects the operator and that outputs a human detection signal indicating whether or not the operator is present, wherein the table unit comprises:

a notched portion that is provided on a first side in a left-right direction and that opens forward and upward;

a recessed portion that is provided on a second side in the left-right direction, the first side being opposite to the first side, the recessed portion comprising an upper surface having a recessed shape; and a light emitter that is provided on at least one of the notched portion and the recessed portion, and that emits visible light to notify the operator of a position at which an article is to be placed when the human detection signal indicates that the operator is present.

2. The input and output device according to claim 1, wherein the recessed portion has a shape corresponding to a beverage container.

3. The input and output device according to claim 1, wherein the table unit has a round shape that protrudes forward.

4. The input and output device according to claim 1, wherein the notched portion comprises a stick holder for hooking a rod-shaped body.

5. The input and output device according to claim 1, wherein the operation unit comprises a numeric pad, and the notched portion is disposed on a side of the numeric pad.

6. The input and output device according to claim 1, wherein the operation unit comprises an intercom, and the recessed portion is disposed on a side of the intercom.

7. The input and output device according to claim 1, wherein the operation unit comprises a numeric pad and an intercom, a distance between the notched portion and the numeric pad is shorter than a distance between the notched portion and the intercom, and a distance between the recessed portion and the intercom is shorter than a distance between the recessed portion and the numeric pad.

8. The input and output device according to claim 1, further comprising:

a light detector that detects the visible light from the light emitter and outputs a detection signal; and a controller that determines, based on the detection signal, whether or not the visible light is blocked by the article placed in the notched portion or the recessed portion when the operator leaves the operation unit, the controller alerting the operator that the article has been forgotten upon determining that the visible light is blocked.

9. The input and output device according to claim 8, wherein the light detector comprises an optical sensor that is provided on the front side, the light detector detecting visible light reflected by at least one of the operator, a background of the operator, and a sheet-shaped article on which information is printed.

10. The input and output device according to claim 8, wherein the light detector comprises a camera that acquires image information.

11. The input and output device according to claim 1, wherein the light emitter comprises:

a first light emitter that is disposed on an edge of the recessed portion and that emits light to indicate a location of the recessed portion; and a second light emitter that is disposed on an edge of the notched portion and that emits light to indicate a location of the notched portion.

12. The input and output device according to claim 11, further comprising:

a light detector that detects visible light emitted from at least one of the first and the second light emitters, and that outputs an article detection signal indicating whether or not the article is placed in at least one of the recessed portion and the notched portion; and a controller that determines that the operator has forgotten the article when the human detection signal indicates that the operator is absent and the article detection signal indicates that the article is placed in the at least one of the recessed portion and the notched portion.

13. The input and output device according to claim 1, wherein the left-right direction is substantially perpendicular to a direction away from the operation unit.

14. A terminal device comprising:

the input and output device according to claim 1; and an active unit that performs at least one of operating an object and displaying information based on data input from the input and output device.

* * * * *